US005939832A

United States Patent [19]

Franck

[11] Patent Number: 5,939,832

[45] Date of Patent: Aug. 17, 1999

[54] SAFETY DISCONNECTION WITH ASYMMETRIC LAMP POWER

[75] Inventor: Felix Franck, Munich, Germany

[73] Assignee: Patent-Treuhand-Gesellschaft fuer elektrische Gluehlampen mbH, Munich, Germany

[21] Appl. No.: 08/853,996

[22] Filed: May 9, 1997

[30] Foreign Application Priority Data

May 15, 1996 [DE] Germany ..... 196 19 580

[51] Int. Cl.[6] ..... H05B 37/03

[52] U.S. Cl. ..... 315/119; 315/209 R; 315/225; 315/308; 315/205

[58] Field of Search ..... 315/225, 205, 315/308, 119, 209 R

[56] References Cited

U.S. PATENT DOCUMENTS 5,023,516 6/1991 Ito et al. ..... 315/101
5,387,846 2/1995 So ..... 315/209 R
5,528,147 6/1996 Konopka ..... 315/225 X

FOREIGN PATENT DOCUMENTS 0 056 481 7/1982 European Pat. Off. .
0 411 618 A2 2/1991 European Pat. Off. .
0 681 414 A2 11/1995 European Pat. Off. .
0 696 157 2/1996 European Pat. Off. .
41 00 349 A1 1/1990 Germany .

*Primary Examiner*—Arnold Kinkead
*Attorney, Agent, or Firm*—Carlo S. Bessone

[57] ABSTRACT

A circuit is proposed for the AC voltage operation of a discharge lamp by means of a coupling capacitor (C3) with a safety disconnection device, connected in series with the lamp for DC current separation, which is characterized by the fact that the safety disconnection device responds to a DC voltage (UC3) at coupling capacitor (C3) by means of a DC current component flowing through the lamp.

5 Claims, 3 Drawing Sheets

SAFETY DISCONNECTION WITH ASYMMETRIC LAMP POWER

BACKGROUND OF THE INVENTION

The present invention concerns an operating circuit for discharge lamps, particularly low-pressure discharge lamps. Here and in the following as well as in the claims, operating circuits for several lamps are also intended, i.e., operating circuits for at least one lamp. Discharge lamps are operated with alternating-current power, usually with a high-frequency power. A coupling capacitor connected in series with the lamp is used for direct-current coupling. Refer to C. H. Sturm and E. Klein "Operating devices and circuits for electrical lamps", 6th Edition 1992, Siemens AG, with respect to the basic structure of such operating circuits.

During ignition and operation of a discharge lamp, different interference states may occur, which can lead to the disruption of the operating circuit and result in safety risks relative to the environment. Therefore, a circuit structure is aimed at, which automatically detects such disruptive states and leads to a disconnection of the lamp.

Circuits with safety disconnection devices are known, which respond to the lamp voltage, thus the voltage released at the discharge segment of the lamp. The invention correspondingly proceeds from a circuit for alternating-current voltage operation of a discharge lamp by means of a coupling capacitor connected in series with the lamp for direct-current separation with a safety disconnection device, as is known for the OSRAM QTEC ballast device.

SUMMARY OF THE INVENTION

The invention takes on the technical problem of further improving the safety and operating properties of the lamp with its operating circuit.

The problem is resolved by a circuit of the named type, which is characterized by the fact that the safety disconnection device responds to a DC voltage at the coupling capacitor via a DC component flowing through the lamp.

Such a DC component arises with asymmetric lamp power (in the extreme case, with failure of a lamp emitter), and consequently leads to a static discharge of the coupling capacitor due to the serial connection of the lamp and the coupling capacitor. It has been shown that the described lamp asymmetry represents an increasingly serious problem. Starting from a non-obligatory, but at present a common over-resonant operation of the circuit—it leads to a distortion of the current-over-time oscillation back to one current sign and thus to a quasi-subresonant behavior with peaks in the current or discontinuities in its first time derivative. This leads to high-frequency interference of the environment and switching-on losses in the frequency generator as well as possibly a disturbance of the circuit and an endangering of its surroundings.

Now if the voltage at the coupling capacitor is monitored in the way according to the invention, the described difficulties can be overcome. The invention thus takes care of safety and economy as well as electromagnetic compatibility of the lamp with its operating circuit.

According to a preferred form of embodiment of the invention, a threshold value circuit of the safety disconnection device is triggered by a specific DC voltage at the coupling capacitor. Preferably this threshold value circuit also responds to an excessive intermediate circuit voltage of the operating circuit.

According to another development, this response is produced by applying a fraction of the intermediate circuit voltage obtained by means of a voltage divider circuit to the mentioned threshold value circuit, whereby the coupling capacitor is connected in parallel to a part of the voltage divider circuit. Thus, the DC voltage at the coupling capacitor can influence the voltage at the voltage divider circuit and thus, like the intermediate circuit voltage, also trigger the threshold value circuit.

According to a particular embodiment, the lamp voltage is also monitored by means of the same named threshold value circuit, i.e., the threshold value circuit is also triggered by an excessive lamp voltage. This can be done by applying a fraction of the lamp voltage to a portion of the voltage divider circuit by means of a circuit, which is designed such that the lamp voltage fraction is superimposed on the applied fraction of the intermediate circuit voltage. An example will be given in the description of the examples of embodiment.

For the case when the circuit structure for monitoring the DC voltage at the coupling capacitor leads to disconnection only in one polarity, a connection point of the voltage divider circuit can be joined by means of a trigger diode with a suitable point of the threshold value circuit, and in fact, this can be done in such a way that the threshold value circuit responds to both polarities of the DC voltage. An example of this is again given in the description of the examples of embodiment.

One design of the circuit according to the invention provides for joining the connection point of the trigger diode or a connection point adjacent in potential by means of a lamp coil with the voltage divider circuit and to connect a resistance between this connection point of the trigger diode or a potentially adjacent connection point and one of the poles of the intermediate circuit voltage as the base potential of the safety disconnection device or another suitable base potential. This resistance is dimensioned such that it draws the potential of the named connection point to the potential of the pole, or as far in the direction to the potential of the pole that the threshold value circuit is triggered by means of the trigger diode, when the lamp is removed from its mounting or when the lamp coil breaks.

According to a simple and advantageous possible solution, the intermediate value circuit is a bistable flip-flop connection, roughly a thyristor equivalent circuit with two transistors.

Frequently, a discharge lamp is operated by means of a push-pull frequency generator with two transistors. Then the safety disconnection device can be constructed such that after its response, it suppresses the control of one of the two transistors by means of a disconnection transistor, and roughly joins the base of one bipolar transistor to ground in a low-ohm manner.

BRIEF DESCRIPTION OF THE DRAWINGS

The invention is described in the following on the basis of three concrete examples of embodiment with reference to the figures. Here.

BEST MODE FOR CARRYING OUT THE INVENTION

An upper part RE1, RE2, of a voltage divider circuit RE1, RE2, R1 is shown in the double-lined frame, whereby a coupling capacitor C3 is connected in parallel to resistance RE1 and this capacitor has DC voltage UC3 released thereon in the case of interference. Thus the value of RE1 is clearly greater than the AC resistance of C3 in the operating frequency of the lamp.

Further, a coil of a low-pressure discharge lamp lies between RE1 and RE2 in the voltage divider circuit. In order to avoid direct currents through the lamp, the lamp coil is applied in the potential center of the voltage divider circuit, since the other lamp coil generally also lies in the potential center of the intermediate circuit voltage, proportional to the DC voltage.

The voltage $U_{meas.}$ released via resistance R1 is conducted to a connection point of a bistable flip-flop connection in the form of a thyristor equivalent circuit comprised of two bipolar transistors when a threshold value voltage UZ of a Zener diode DZ1 is exceeded. This flip-flop connection has one stable state, in which both transistors are conducting and another stable state, in which both transistors are not conducting.

In the conducting state, the base of an npn disconnection transistor is controlled by means of the depicted output signal line in such a way that the latter becomes conducting and short-circuits the base of another transistor, also not shown, of a push-pull frequency generator operating the lamp in a low-ohm manner opposite ground. The flip-flop connection on the emitter side of the above transistor is supplied with voltage in a suitable way from this push-pull frequency generator, so that an intrinsic voltage supply is superfluous.

With respect to the named particulars and other special features of the internal and external circuit of the flip-flop connection (with the remaining operating circuit of the lamp), reference is expressly made to the disclosure of Application DE 195 05 459.8 of the Applicant. In particular, the energy for the base current of the disconnection transistor is formed by a triggering capacitor for starting the frequency generator. In addition, the collector-emitter segment of the disconnection transistor lies directly between the base of one of the transistors of the frequency generator and ground.

Figure 1:
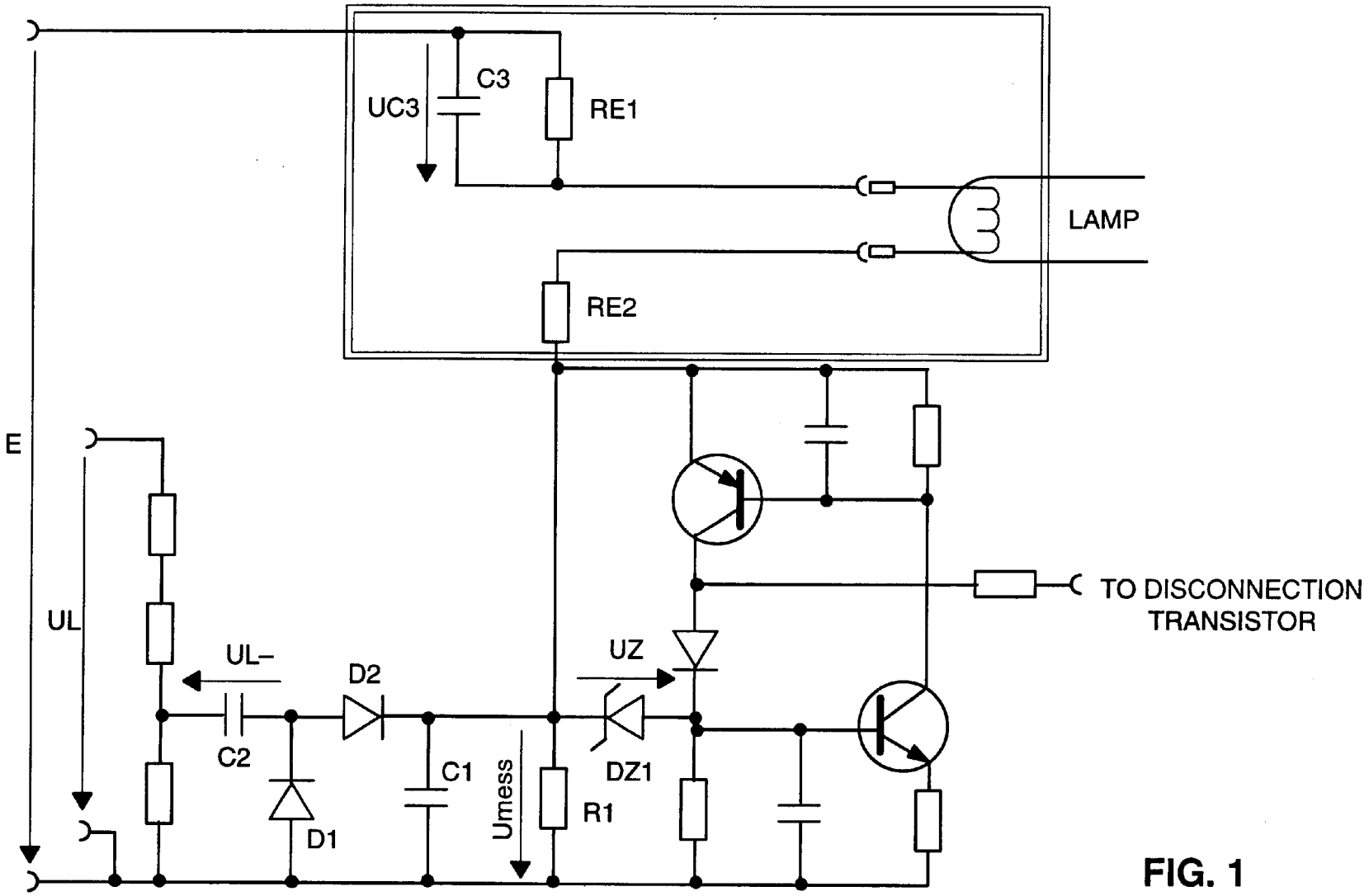
FIG. 1 shows the first embodiment for the lamp circuit.

As is indicated at the left in FIG. 1, the intermediate circuit voltage E of a large filter capacitor (not shown) is applied in front of the push-pull frequency generator in the described voltage divider circuit, C3, RE1, RE2, R1.

The lamp voltage UL indicated on the left is applied to another voltage divider circuit, not designated in more detail, which is stepped down uniformly in the two half waves and is added by diodes D1 and D2 and capacitor C2 at capacitor C1. An asymmetry of the lamp voltage can thus not be detected here.

This voltage is coupled in a measurement resistance R1 in a way known by the person skilled in the art, whereby it is superimposed on the fraction of the intermediate circuit voltage E resulting from voltage divider circuit C3, RE1, RE2, R1. Clearly stated, an addition of the currents reverting to voltages E and UL occurs with corresponding superimposition of the voltages released at R1.

It is clear that the circuit shown in FIG. 1 with a single threshold value circuit monitors three different operating values of the operating circuit and thus detects disruptive states in a comprehensive manner and can convert this detection into a disconnection of the lamp operation.

Figure 2:
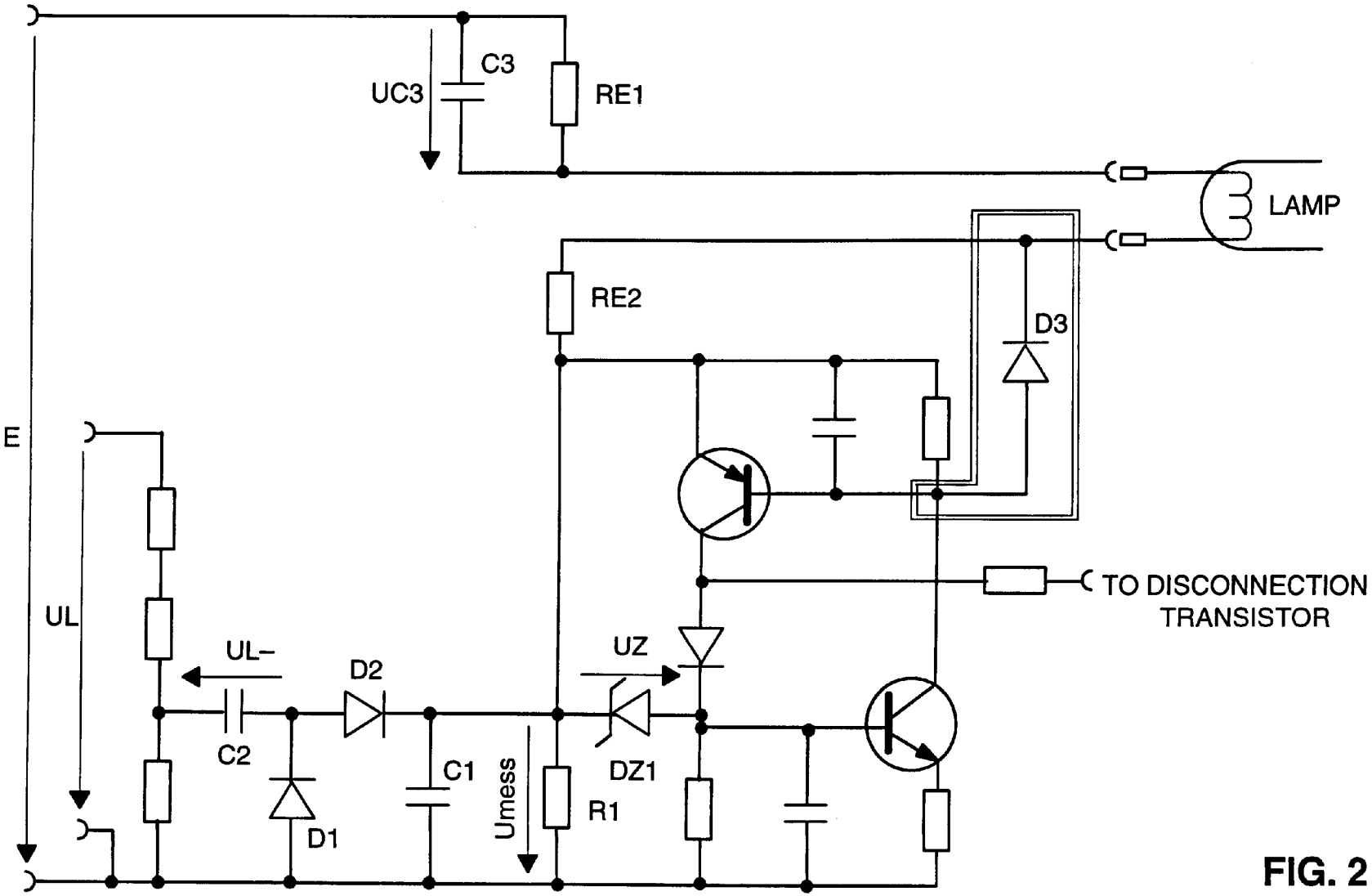
FIG. 2 shows the second embodiment for the lamp circuit.

The circuit shown in FIG. 2 corresponds to the one just described except for the doubly framed additional trigger diode D3 between the base of the upper transistor of the flip-flop connection and a connection point between resistance RE2 and coupling capacitor C3 or here the lamp coil.

The trigger diode has its basis in the fact that the voltage divider circuit converts only one of the charges counter to intermediate circuit voltage E or voltage UC3 at coupling capacitor C3 into a trigger signal via Zener diode DZ1, since only then is the measurement voltage $U_{meas}$ amplified. In the charging of coupling capacitor C3 opposite to this, the potential at the upper connection point of trigger diode D3 decreases, so that this diode can then draw the potential at the base of the upper flip-flop circuit transistor and thus can trigger the flip-flop connection into the conducting state.

Figure 3:
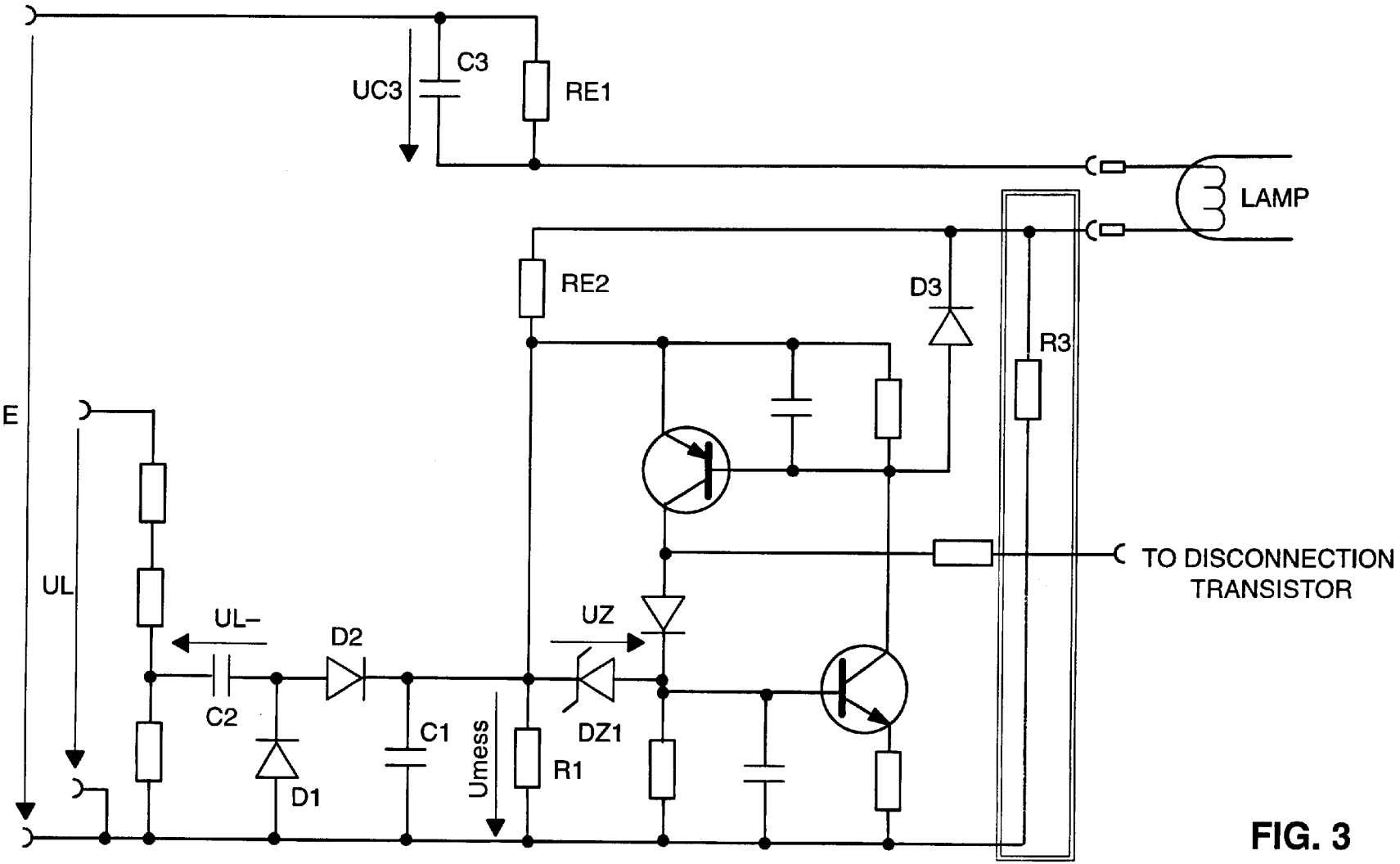
FIG. 3 shows the third embodiment of the lamp circuit.

Finally, FIG. 3 shows the same circuit as FIG. 2, but also with a resistance R3, here a "pull-down resistance", between the upper connection point of trigger diode D3 and the lower pole of intermediate circuit voltage E. This resistance is dimensioned such that it brings the potential of its upper connection point in the direction of the potential of the lower pole of intermediate circuit voltage E when a lamp is not present or when there is a break in the coil, or the like, i.e., it is clearly a lower-ohm resistance than RE2. In this way, the flip-flop connection is also triggered by trigger diode D3 even when there is a break in the coil or the lamp is removed. Since the lamp coil must lie in the potential central point of the voltage divider circuit C3, RE1, RE2, R1, or the intermediate circuit voltage E, an adaptation of the other resistances of the voltage divider circuit is necessary due to R3, and is found approximately according to:

$$RE1=((RE2+R_{meas.})R^3)/(RE2+R_{meas.}+R3).$$

The last described function of the circuit of FIG. 3 is particularly practical, if a lamp is removed from a relatively large lighting device containing many lamps. Then the disconnection of the entire lighting device is superfluous, so that operation can commence rapidly and with normal lighting.

In the following, in conclusion, several typical values for several of the described component parts of the applications of embodiment will be given: the resistances in the UL voltage divider lie in the region of several 100 kilohms and depend on the lamp dimensions. C2 amounts to several picofarads with sufficient voltage strength (E/2). The voltage strength of diodes D1 and D2 corresponds to the highest voltage arising in the safety disconnection, i.e., UZ plus a 10% safety factor. C1 lies in the microfarad region; large time constants are necessary for attenuating the ignition pulse. The Zener voltage UZ lies between 16 and 30 volts. The value of the coupling capacitor C3 lies in the range of 22 to 47 nanofarads and depends on the lamp dimensions. Thus, e.g.:

RE1=330 kilohms
RE2=1.2 megohm
R1=180 kilohms
R3=470kilohms
D3 blocks at least E/2
C1=2.2 microfarads
C2=680 picofarads As a precaution, the Applicant claims herewith protection for the invention independent of the remaining disclosure: when there is a safety disconnection device, to shift the potential of the connection point when current conduction is not present, by through the coil in such a way that the safety disconnection device responds, by means of a resistance between a connection point, which is influenced proportional to potential, and a suitable base potential.

What is claimed is:

1. A circuit for the AC voltage operation of a discharge lamp by means of a coupling capacitor (C3) with a safety disconnection device, connected in series with the lamp for DC current separation, is hereby characterized in that:

the safety disconnection device has a threshold value circuit triggered by a specific DC voltage (UC3) at the coupling capacitor (C3) and by an excessive intermediate circuit voltage (E), a fraction of the intermediate circuit voltage (E) obtained by means of a voltage divider circuit (RE1, RE2, R1) is applied to the threshold value circuit, whereby the coupling capacitor (C3) is parallelly connected to a part of the voltage divider circuit (RE1, RE2, R1), a connection point of the voltage divider circuit (RE1, RE2, R1) is joined by means of a trigger diode (D3) with the threshold value circuit in such a way that the threshold value circuit is triggered by a DC voltage (UC3) at coupling capacitor (C3), the trigger diode (D3) is joined by means of a lamp coil with the voltage divider circuit and a resistance (R3) is connected between the connection point of trigger diode (D3) and a pole of the intermediate circuit voltage (E), the resistance (R3) being designed for the purpose of drawing the potential of the connection point in the direction of a lower pole when the lamp is removed or there is a break in the lamp coil, in order to trigger the threshold value circuit by means of trigger diode (D3).

2. The circuit according to claim 1, in which a fraction of the lamp voltage (UL) is applied to a part of the voltage divider circuit (RE1, RE2, R1) in such a way that it is superimposed on a fraction of the intermediate circuit voltage (E).

3. The circuit according to one of claim 1, in which the threshold value circuit is a bistable flip-flop connection.

4. The circuit according to claim 3, in which the bistable flip-flop connection is a thyristor equivalent circuit with two transistors.

5. The circuit according to a claim 1, in which the lamp is operated by means of a push-pull frequency generator with two transistors and the safety disconnection device suppresses the control of one of the two transistors after its response by means of a disconnection transistor.

* * * * *